United States Patent [19]

Bolza-Schünemann

[11] 3,942,787

[45] Mar. 9, 1976

[54] SHEET FEEDING APPARATUS FOR PRINTING PRESSES

[75] Inventor: Hans Bernhard Bolza-Schünemann, Wurzburg, Germany

[73] Assignee: Koenig & Bauer Aktiengesellschaft, Wurzburg, Germany

[22] Filed: June 4, 1974

[21] Appl. No.: 476,190

[30] Foreign Application Priority Data

June 15, 1973 Germany ..... 2330484

[52] U.S. Cl. ..... 271/237; 271/241; 271/276

[51] Int. Cl.[2] ..... B65H 9/00; B65H 5/06

[58] Field of Search ..... 271/236–239, 271/231, 248–252, 245, 247, 241, 226–228, 270, 276, 277, 194, 196

[56] References Cited

UNITED STATES PATENTS

| | | | |
|---|---|---|---|
| 1,292,968 | 1/1919 | Stevens | 271/276 X |
| 2,809,831 | 10/1957 | Nordquist | 271/250 X |
| 2,984,482 | 5/1961 | Kist et al. | 271/237 X |
| 3,743,277 | 7/1973 | Bolza-Schunemann et al. | 271/237 X |

FOREIGN PATENTS OR APPLICATIONS

| | | | |
|---|---|---|---|
| 653,308 | 4/1935 | Germany | 271/237 |

*Primary Examiner*—Evon C. Blunk
*Assistant Examiner*—Bruce H. Stoner, Jr.
*Attorney, Agent, or Firm*—Jones, Tullar & Cooper

[57] ABSTRACT

A sheet feeding table has pull-type side lays and front lays. Mounted beneath the feeding table and nearer the front lays are suction drums spaced apart and rotated by a transversely extending drive shaft on which they are mounted. The shaft is driven through toothed wheels having relative axial movement with respect to each other. A cam plate rotates with the shaft and a pair of fixedly mounted rollers guide the cam plate and impart reciprocating motion to the shaft and the suction drums. The lateral shifting of the suction drums clears the sheet from the pull-type side lay for the successive sheet. Each drum has a suction piece sealed and biasedly positioned adjacent a portion of the inside peripheral surface of the drum which rotates thereby and brings the drum suction holes into communication with the suction chamber within the suction piece. The suction chamber is in communication with a vacuum supply and a control valve is interposed in the supply. The sheets are fed to an impression cylinder having front stops and a series of sheet grippers. The speed of the drums is raised somewhat excessively to convey the sheets against the front stop in the impression cylinder.

4 Claims, 2 Drawing Figures

SHEET FEEDING APPARATUS FOR PRINTING PRESSES

BACKGROUND OF THE INVENTION

The invention relates to an apparatus for use in transferring sheets on printing presses from a feed table to a continuously rotating impression cylinder, in which the sheets are gripped in position of rest by a conveying device, are accelerated to peripheral speed of the impression cylinder, and are delivered to the grippers of the impression cylinder.

Mechanisms of this general kind are already known. The conveying device described in the German Patent Specification No. 1,123,678 comprises drive rolls between which the sheet is clamped, and by which it is transferred against front stops on the impression cylinder. Such clamping causes the risk of marks impressed on the sheet.

SUMMARY OF THE INVENTION

It is an object of the present invention to provide an apparatus by means of which the sheets can be fed at a high speed, so that the output of the printing press is increased. Furthermore, any risk of impressing marks on the sheet is eliminated.

According to the invention, this object is accomplished by the fact that the conveying device comprises a number of suction drums which are disposed below the feed table and, which are capable of partly being provided with vacuum admission, and of laterally being shifted, in order to clear the pull-type side lay for the successive sheet.

From the German Patent Specification No. 653,308, a pull gripper is known which pulls the sheet off the pull-type side lay after the registering procedure. This pull gripper meshes with the grippers of its gripper series between the grippers of the next cylinder, i.e. of the impression cylinder. Hitherto one has not succeeded in coordinating the grippers of the pull gripper and those of the impression cylinder in such a way that sheets can be registered alternately on the left or on the right side of the feed table without collision of the grippers of the pull gripper with the grippers of the impression cylinder. Thus the proposition described in the present specification has not yet been realized.

By means of the apparatus according to the present invention, the output of a printing press can be increased, as the pull-type side lay has already been cleared of the first sheet before this is pulled off over its whole length. Furthermore, the suction drums also accomplish another object. They can be used with sheets that are short in relation to the impression cylinder circumference, without lateral shifting, as simple and not very expensive conveying devices. They are particularly advantageous because any marks which may be impressed on the sheet by the drive rolls described in the German Patent Specification No. 1,123,678, can thus be avoided.

DESCRIPTION OF THE DRAWINGS

An embodiment of the invention is hereinafter described, by way of example only, with reference to the accompanying drawings, in which.

DESCRIPTION OF A PREFERRED EMBODIMENT

Figure 1:
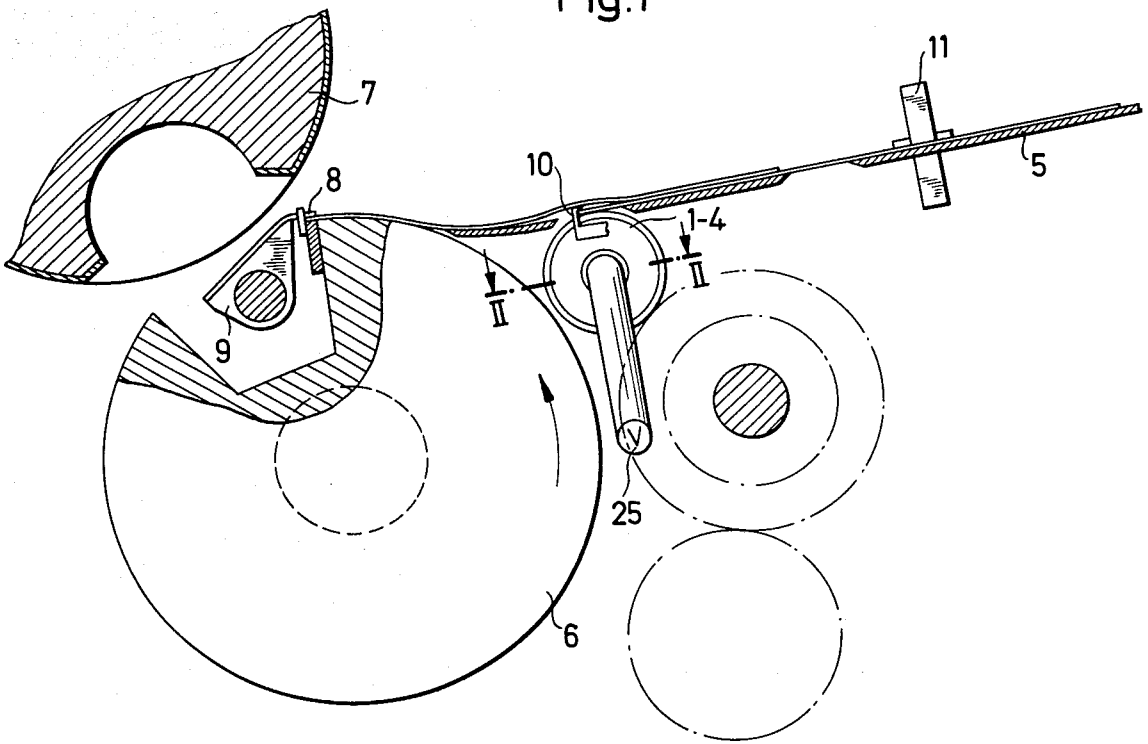
FIG. 1 is a side view of the apparatus.
Figure 2:
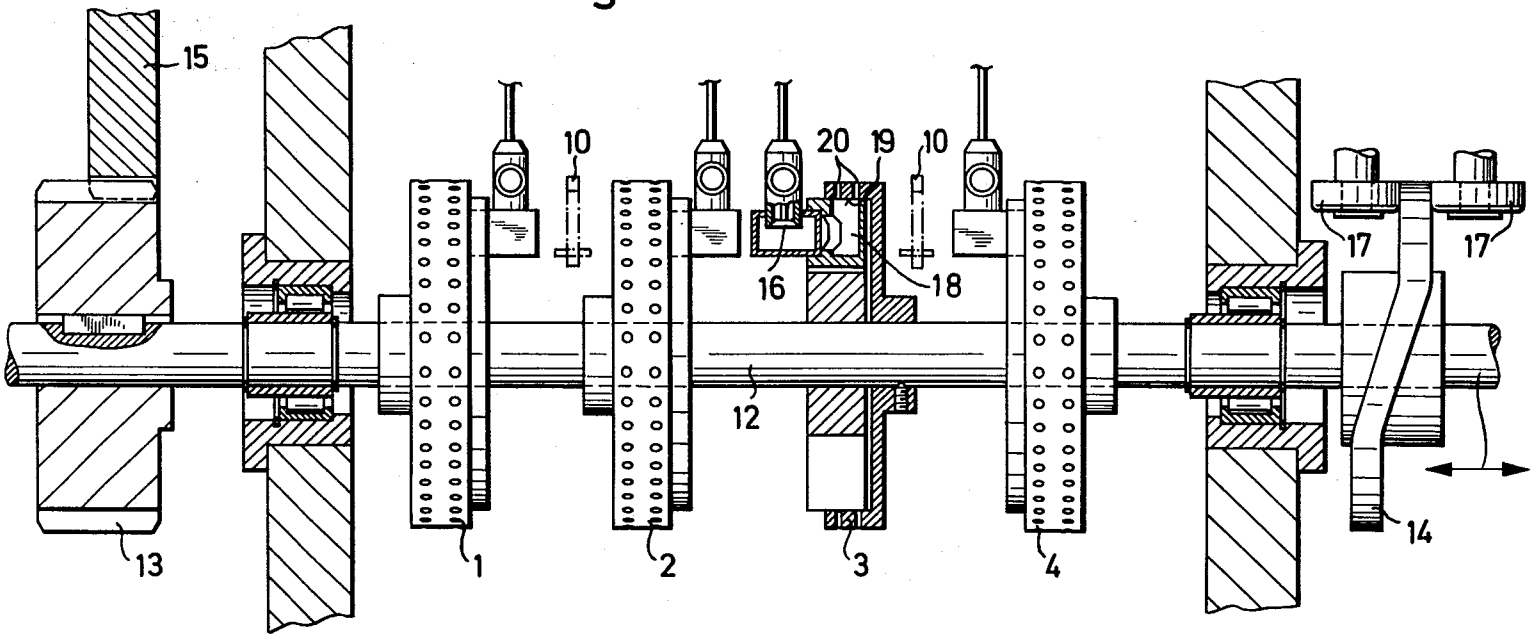
FIG. 2 is a sectional view along line II — II of FIG. 1.

Throughout the description, like reference numbers refer to similar parts.

Suction drums 1 to 4 are located under a feed table 5 between front lays and side lays. Drums 1 to 4 are accelerated from a position of rest to a peripheral speed somewhat higher than that of an impression cylinder 6, to which feed table 5 transfers the sheets. A rubber covered or plate cylinder 7 coacts with impression cylinder 6. On impression cylinder 6, front stops 8 and a series of grippers 9 are located. On feed table 5, front lays 10, capable of being withdrawn under feed table 5, and side lays 11, by means of which the sheets can be laterally registered, are located.

After registering of the sheets against front lays 10 and side lays 11, the sheets are seized by the suction drums 1 to 4, are accelerated, and are delivered to the impression cylinder 6. Suction drums 1 to 4 are positioned on a shaft 12, on which a toothed wheel 13 and a cam disk 14 are fastened by means of keys. Toothed wheel 13 is in mesh with a toothed wheel 15 which is driven by the main drive of the printing press by means of an intermittent driving gear. Toothed wheel 13, which is secured on shaft 12, is axially slidable with respect to toothed wheel 15. By the cam disk 14 which runs between two rolls 17 mounted in the press frame, shaft 12 and thus suction drums 1 to 4 are rhythmically driven in reciprocating motion. Cam disk 14 is capable of causing, by twisting, a positive or negative shifting. Shifting can also be effected individually by means of an individual drive, it must, be invertible according to the position of the pull-type lay. Control of suction of the suction drums 1 to 4 is effected by means of valves 16, which are located between a suction source not shown in the figures, and suction chambers 18. These are located inside the suction drums 1 to 4, are precision fitted to the radius of the inside peripheral surface 19, and are pressed by spring resilience to the inside peripheral surface of suction drums 1 to 4, so that the inside of suction chamber 18 is sealed against the environment. Suction drums 1 to 4 are, at their circumference, provided with holes 20 through which the sheet is sucked and is driven when the suction drums 1 to 4 are rotating.

What I claim is:

1. In a sheet feeding apparatus useable for feeding sheets to the continuously rotating impression cylinder of a sheet-fed rotary printing press, and including a feed table having spaced front lays and side pull-type lays, a suction conveying device for grasping the sheets from the feed table and transferring the sheets to the grippers of the impression cylinder, the suction conveying device comprising:

at least two spaced apart rotary suction drums affixed on an axially shiftable shaft positioned generally beneath the feed table and between the front and side lays;

means operable to axially shift said shaft; and means for applying vacuum to an interior portion of each of said suction drums together with means on said drums for communicating said vacuum to an outer surface of each of said drums whereby a sheet may be grasped by said rotary suction drums and forwarded for engagement with the grippers of the impression cylinder.

2. The apparatus of claim 1 wherein said means operable to axially shift said shaft is a cam disc affixed to said shaft, said cam disc engaging guide means to cause said axial shifting of said shaft.

3. The apparatus of claim 1 wherein said means for applying vacuum to an interior portion of each of said suction drums is a suction chamber mounted inside the drum and pressed to the inside peripheral surface of said drums and further wherein said suction chamber communicates with suction holes in said drum whereby said vacuum in said suction chamber is communicated to an outer surface of said drum.

4. The apparatus of claim 1 wherein said rotary suction drums are positioned generally beneath the feed table and between the front and side lays close to the front lays.

* * * * *